US010537211B2

(12) United States Patent
Verrengia

(10) Patent No.: US 10,537,211 B2
(45) Date of Patent: Jan. 21, 2020

(54) SHOWER SCRUBBING DEVICE

(71) Applicant: Nick Verrengia, New Port Richey, FL (US)

(72) Inventor: Nick Verrengia, New Port Richey, FL (US)

( * ) Notice: Subject to any disclaimer, the term of this patent is extended or adjusted under 35 U.S.C. 154(b) by 39 days.

(21) Appl. No.: 15/472,210

(22) Filed: Mar. 28, 2017

(65) Prior Publication Data

US 2017/0280945 A1 Oct. 5, 2017

Related U.S. Application Data

(60) Provisional application No. 62/316,313, filed on Mar. 31, 2016.

(51) Int. Cl.
*A47K 7/04* (2006.01)
*A47K 7/02* (2006.01)

(52) U.S. Cl.
CPC ..... *A47K 7/022* (2013.01); *A47K 7/04* (2013.01)

(58) Field of Classification Search
CPC ..... A47K 7/04; A47K 7/022
See application file for complete search history.

(56) References Cited

U.S. PATENT DOCUMENTS 5,345,640 A * 9/1994 Goss ..... A46B 13/04 15/21.1
5,561,869 A * 10/1996 Sarel ..... A47K 7/046 4/606
6,996,861 B1 * 2/2006 Clark, Jr. ..... A47K 7/04 4/606

* cited by examiner

*Primary Examiner* — Randall E Chin
(74) *Attorney, Agent, or Firm* — Bruce A. Lev

(57) ABSTRACT

A shower scrubbing device is an apparatus that attaches to a shower wall that has three back scrubbing discs with removable scrubbing covers, located on the front of the device that rotate via a motorized gear set behind the front cover and are adjustable in height using a carriage designed to be moved along a vertical track. A shaft for each back-scrubbing disc extends through parallel elongated slots for adjusting height, and attach to a respective gear in the gear set behind the front cover. The shower scrubbing device is battery operated.

20 Claims, 4 Drawing Sheets

SHOWER SCRUBBING DEVICE

CROSS-REFERENCE TO RELATED APPLICATION

The present application is related to and claims priority from prior provisional application Ser. No. 62/316,313, filed Mar. 31, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of back scrubbing and massaging devices and more specifically relates to a shower scrubbing device.

2. DESCRIPTION OF THE RELATED ART

For most of people, washing the upper and lower back areas while showering can be challenging. This is especially true for the older demographic and the physically challenged. Many use a brush with a long handle, but those with joint and/or wrist pain are unable to apply the amount of pressure needed to scrub when using a long-handled back brush. Others tend to rely on the shampoo lather that runs down their backs while it is being rinsed from their hair for the best available option of getting a clean backside. Most would agree that their backs tend to get neglected when bathing since a second person is not often available for assisting, and so the back becomes the most neglected area of the body when cleaning. A need exists for a specially designed solution for this age-old problem.

Various attempts have been made to solve the above-mentioned problems, however, none of the above inventions and patents, taken either singly or in combination, is seen to describe the invention as claimed.

Ideally, a back scrubbing and massaging device should provide a portable, ergonomically-designed, shower wall-mounted, motorized, remote-controlled, rechargeable back scrubber/massager structured and arranged to clean the user's back thoroughly from top to bottom, including the hard to reach small of the back area, and yet, would operate reliably and be manufactured at a modest expense. Thus, a need exists for a reliable shower scrubbing device to avoid the above-mentioned problems.

BRIEF SUMMARY OF THE INVENTION

In view of the foregoing disadvantages inherent in the known back scrubbing and massaging device art, the present invention provides a novel shower scrubbing device. The general purpose of the present invention, which will be described subsequently in greater detail, is to provide a portable, ergonomically-designed, shower wall-mounted, motorized, remote-controlled, rechargeable back scrubber/massager structured and arranged to clean the user's back thoroughly from top to bottom, including the hard to reach small of the back area.

The shower scrubbing device may comprise a wall bracket member that is removably attachable to a shower wall, a carriage member that is adapted to move with respect to the wall bracket member, and at least one rack and pinion mechanism mechanically connected between the wall bracket member and the carriage member and includes at least one sprocket member attached thereto adapted to connect with a respective back scrubbing disc member.

At least one back scrubbing disc member is connected to a respective sprocket member and is adapted to move with respect to the wall bracket member when the carriage member moves in an up-and-down fashion. A motor member is connected between the wall bracket member and the carriage member, and is adapted to move the carriage member in an up-and-down fashion and thereby the rack and pinion mechanism and at least one back scrubbing disc member. A power source is connected to the wall bracket member and is electrically connected to the motor member. The power source is formed as a battery member. A control member is electrically connected to the motor member and controls the speed and direction of rotation of the motor member and thereby the motion of each of the back scrubbing disc members.

The carriage member includes at least one elongated track member that a respective sprocket member follows along when the carriage member moves with respect to the wall bracket member. There are three back scrubbing disc members attached to three respective sprocket members which are attached to three respective rack and pinion mechanisms. The carriage member includes three elongated track members that three respective sprocket members follow along when the carriage member moves with respect to the wall bracket member. The elongated track member of the carriage member is formed having an oval shape and have a length of approximately eighteen inches. Each sprocket member travels in an up-and-down fashion along each elongated track member in a cyclical pattern. There is also a cleaning cover removably attached to each back scrubbing disc member. Each cleaning cover includes a material thereon chosen from a group of materials consisting of cotton, nylon, sponge, rubber, metal, and plastic. The cover member is adapted to releasably connect with the wall bracket member and cover the carriage member, the rack and pinion mechanism(s), the sprocket member, the motor member, and the power source. The cover member includes a gasket member attached thereto and is adapted to be located between the cover member and the wall bracket member and prevent moisture from passing into the shower scrubbing device when in use.

The wall bracket member is removably attachable to the shower wall via at least one suction cup member connected to the backside and has a storage tray connected to the front side. Each back scrubbing disc is formed having a diameter of approximately seven inches. The wall bracket member preferably also includes a plurality of utility hooks attached to the front side for holding bathing accessories.

The control member is electrically connected to the motor member via an elongated electric cable member and includes at least one control button thereon to control the motor member. The control member further includes at least one light emitting diode member thereon adapted to indicate the status of power to the motor member. The wall bracket member is formed as two bracket members adjustably attached to one another to thereby allow the wall bracket member to be adjustable in height after it has been attached to the shower wall. The two bracket members are adjustably attached to at least one spring member and at least one releasable attachment member. The releasable attachment member(s) includes a spring biased pin member.

The present invention holds significant improvements and serves as a shower scrubbing device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, shower scrubbing device, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a back scrubbing and massaging devices and more particularly to a shower scrubbing device as used to improve the portability, ergonomic design, efficiency, and convenience of a motorized, remote-controlled, rechargeable back scrubber/massager structured and arranged to clean the user's back thoroughly from top to bottom, including the hard to reach small of the back area.

Generally speaking, a shower scrubbing device is an apparatus that attaches to a shower wall that has three back scrubbing discs with removable scrubbing covers, located on the front of the device that rotate via a motorized gear set behind the front cover and are adjustable in height using a carriage designed to be moved along a vertical track. A shaft for each back scrubbing disc extends through parallel elongated slots for adjusting height, and attach to a respective gear in the gear set. The shower scrubbing device is battery operated.

Figure 1:
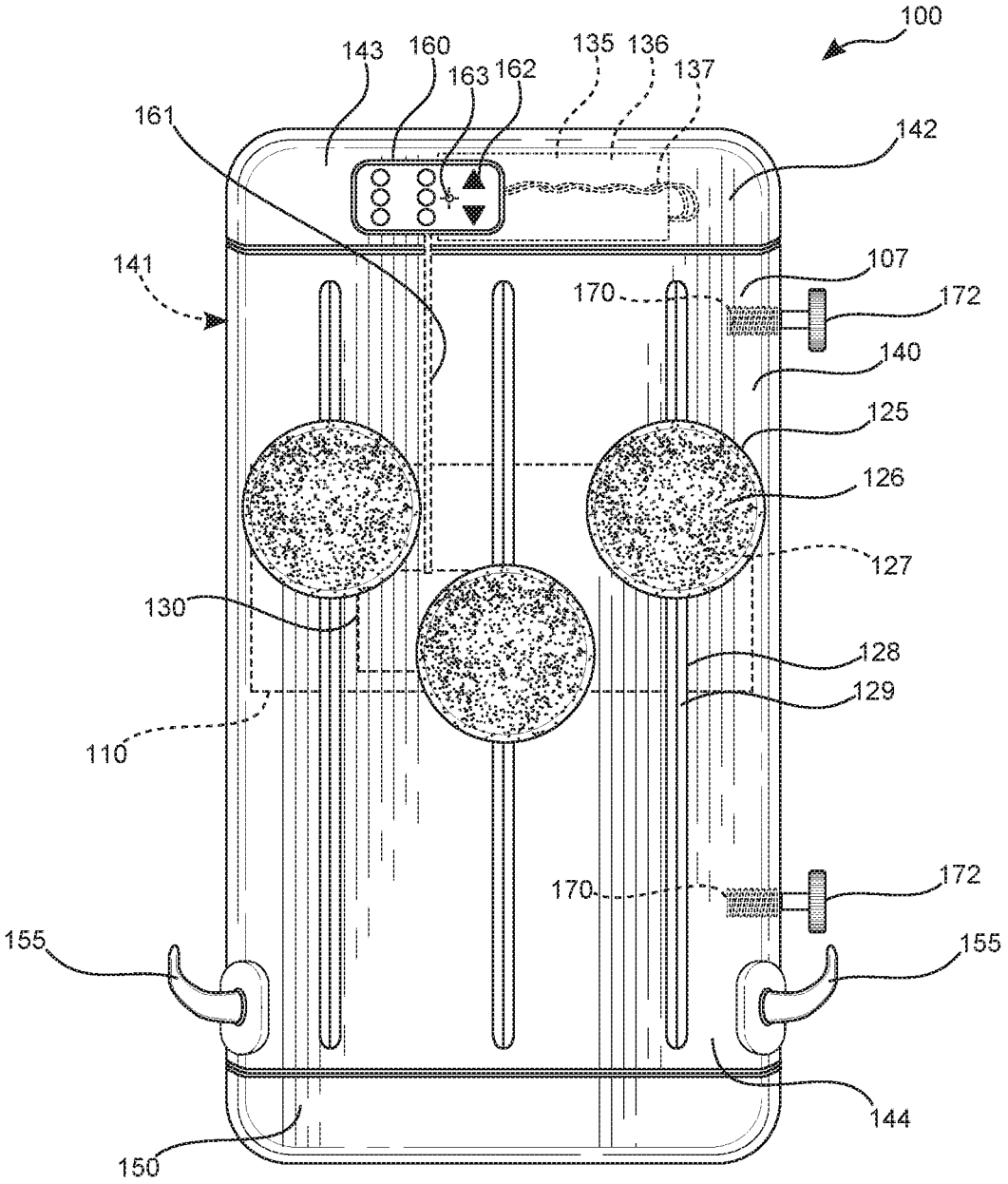
FIG. 1 shows a front elevation view illustrating a shower scrubbing device according to an embodiment of the present invention.

In greater detail now, referring to the drawings by numerals of reference there is shown in FIG. 1, a front elevation view illustrating a shower scrubbing device according to an embodiment of the present invention.

Shower scrubbing device 100 is constructed as a three piece product (number of main components may be more or less) that can be attached to the shower wall surface within minutes and is fully adjustable to accommodate the height of each individual user. Shower scrubbing device 100 has three back scrubbing disc member(s) 125 that are gear operated to rotate circularly and are adjusted in height by shaft(s) 127 which protrude outwardly through slots 128 in cover member 140 which prevents contact with the internal rack and pinion mechanism 115 and other moving parts while being aesthetically appealing. Pinion gear(s) 116 on the inside have a center shaft(s) 127 extending outwardly to a plurality of back scrubbing disc member(s) 125 on the outside. Shower scrubbing device 100 is sealed against water intrusion by cleaning cover 126 covering back scrubbing disc member(s) 125 and rubber slot flaps 129. There may be other methods for making shower scrubbing device 100 water resistant instead or in addition to the above. At top side 142 of cover member 140 there is a removable battery cover 143 for operation of back scrubbing disc member(s) 125 through direct current power. Bottom end 144 of cover member 140 has storage tray 150 that pivots and drops down when opened. Exteriorly located on one side are two spring biased pin member(s) 172, the upper spring biased pin member(s) 172 for limiting the upper movement of carriage member 110 and the lower spring biased pin member(s) 172 for limiting the lower movement of carriage member 110. Additional optional functions may be included in some embodiments such as side speakers for music or cell phone and operated via BLUETOOTH technology.

Figure 2A:
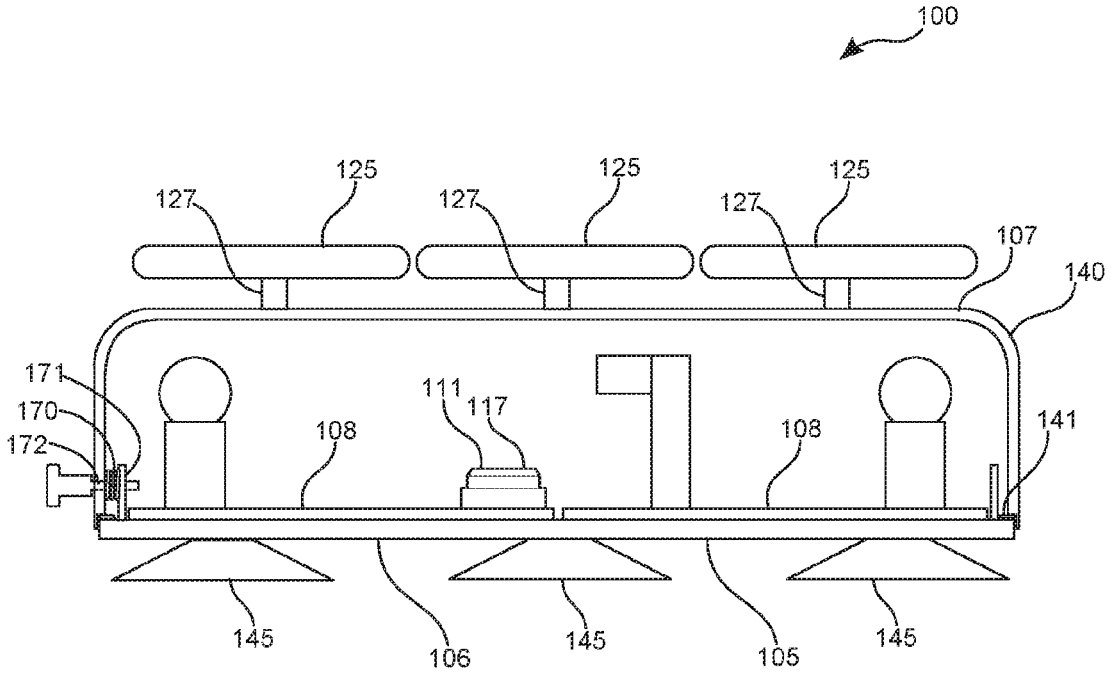
FIG. 2A is a top view illustrating the wall bracket member of the shower scrubbing device according to an embodiment of the present invention of FIG. 1.

Referring now to FIG. 2A, is a top view illustrating the wall bracket member 105 and carriage member 110 of shower scrubbing device 100 according to an embodiment of the present invention of FIG.

Shower scrubbing device 100 may comprise wall bracket member 105 that is removably attachable to the shower wall, carriage member 110 that is adapted to move with respect to wall bracket member 105, and at least one rack and pinion mechanism 115 mechanically connected between wall bracket member 105 and carriage member 110 and includes at least sprocket member 120 attached thereto adapted to connect with a respective back scrubbing disc member(s) 125.

Wall bracket member 105 is removably attachable to the shower wall via at least one suction cup member 145 connected to backside 106 and has storage tray 150 connected to front side 107. Each back scrubbing disc member (s) 125 is formed having a diameter of approximately seven inches. Wall bracket member 105 preferably also includes a plurality of utility hooks 155 attached to front side 107 or extending to the sides for holding bathing accessories such as bathing cloths.

Figure 2B:
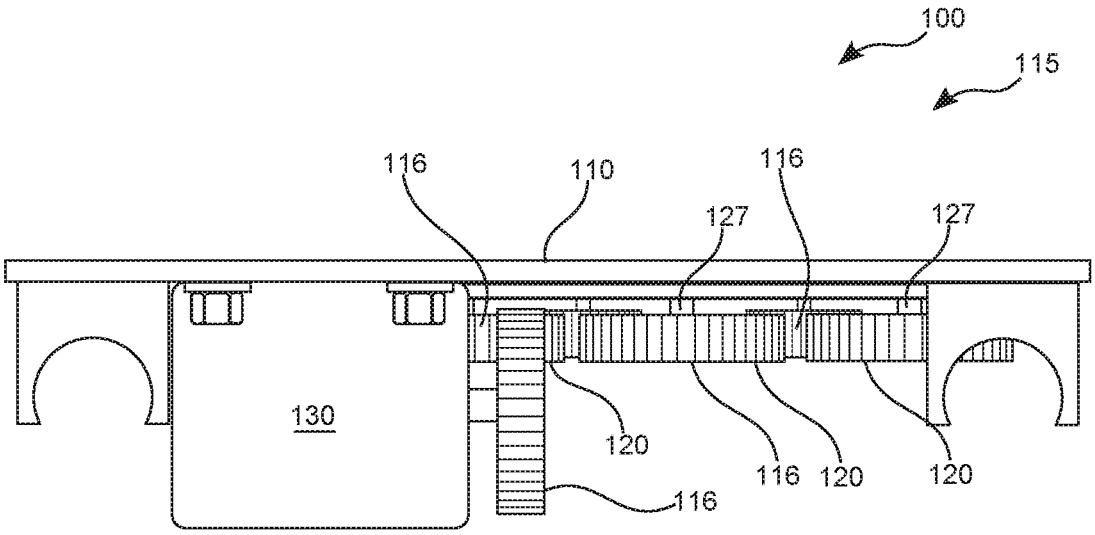
FIG. 2B is a top view illustrating the motor and rack and pinion gears of the shower scrubbing device according to an embodiment of the present invention of FIG. 1.

Referring now to FIG. 2B, is a top view illustrating shower scrubbing device 100 according to an embodiment of the present invention of FIG. 1.

At least one back scrubbing disc member(s) 125 is connected to a respective sprocket member 120 and is adapted to move with respect to wall bracket member 105 when carriage member 110 moves in an up-and-down fashion. Motor member 130 is connected between wall bracket member 105 and carriage member 110, and is adapted to move carriage member 110 in an up-and-down fashion and thereby rack and pinion mechanism 115 and at least one back scrubbing disc member(s) 125. Power source 135 is connected to wall bracket member 105 and is electrically connected to motor member 130. Power source 135 is formed as battery member 136. Control member 160 is electrically connected to motor member 130 and controls the speed and direction of rotation of motor member 130 and thereby the motion of each of back scrubbing disc member (s) 125.

Control member 160 is electrically connected to motor member 130 via elongated electric cable member 161 and includes at least one control button 162 thereon to control motor member 130. Control member 160 further includes at least one light emitting diode member 163 thereon adapted to indicate the status of power to motor member 130. Wall bracket member 105 is formed as two bracket members 108 adjustably attached to one another to thereby allow wall bracket member 105 to be adjustable in height after it has been attached to the shower wall. The two bracket members 108 are adjustably attached to at least one spring member 170 and at least one releasable attachment member 171. Releasable attachment members 171 includes spring biased pin member(s) 172.

Figure 3:
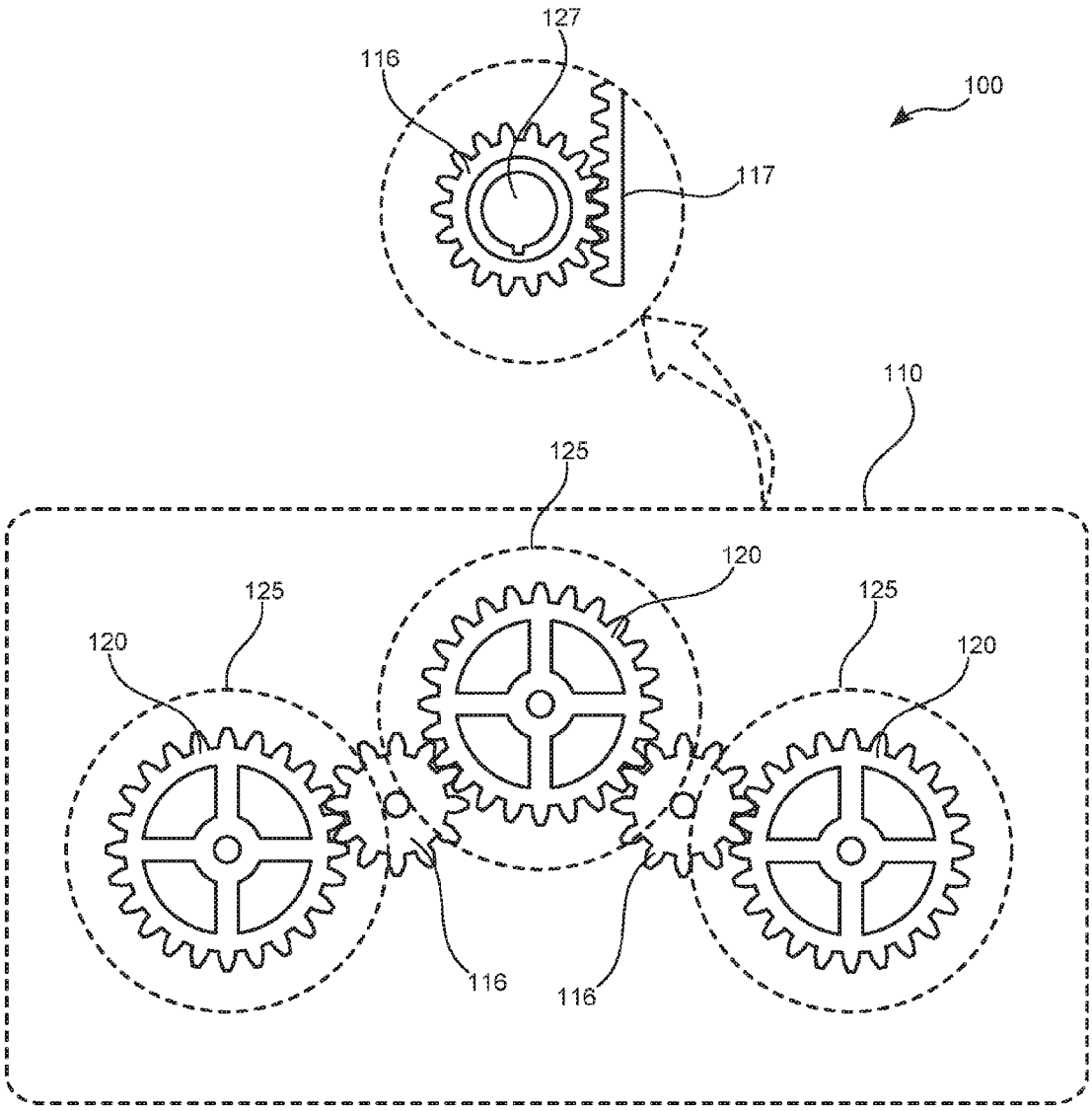
FIG. 3 is a front view illustrating the rack and pinion and carriage of the shower scrubbing device according to an embodiment of the present invention of FIG. 1.

Referring now to FIG. 3, is a front view illustrating the rack and pinion of the shower scrubbing device according to an embodiment of the present invention of FIG. 1.

Carriage member 110 includes at least one elongated track member 111 that a respective sprocket member 120 follows along when carriage member 110 moves with respect to wall bracket member 105. There are three back scrubbing disc member(s) 125 attached to three respective sprocket members 120 which are attached to three respective rack and pinion mechanism(s) 115. Carriage member 110 includes three elongated track member(s) 111 that three respective sprocket member(s) 120 follow along when carriage member 110 moves with respect to wall bracket member 105. Elongated track member(s) 111 of carriage member 110 is formed having an oval shape and have a length of approximately eighteen inches. Sprocket member(s) 120 travels in an up-and-down fashion along each elongated track member (s) 111 in a cyclical pattern. There is also cleaning cover 126 removably attached to each back scrubbing disc member(s) 125. Each cleaning cover 126 includes a material thereon chosen from a group of materials consisting of cotton, nylon, sponge, rubber, metal, and plastic. Cover member 140 is adapted to releasably connect with wall bracket member 105 and cover carriage member 110, rack and pinion mechanism (s) 115, sprocket member(s) 120, motor member 130, and power source 135. Cover member 140 includes gasket member 141 attached thereto and is adapted to be located between cover member 140 and wall bracket member 105 and prevent moisture from passing into shower scrubbing device 100 when in use.

Shower scrubbing device 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other accessory contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., adjustments in size, shape, exact materials of construction, including or excluding certain operation or maintenance steps, addition or exclusion of necessary components to enable the novel aspects of the invention etc., are understood and may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A shower scrubbing device comprising:

a wall bracket member;

wherein said wall bracket member is removably attachable to a shower wall;

a carriage member:

wherein said carriage member is adapted to move with respect to said wall bracket member;

at least one rack and pinion mechanism;

wherein said at least one rack and pinion mechanism is mechanically connected between said wall bracket member and said carriage member; and wherein said at least one rack and pinion mechanism includes at least one sprocket member attached thereto adapted to connect with a respective back scrubbing disc member;

at least one back scrubbing disc member;

wherein each said at least one back scrubbing disc member is connected to a respective said at least one sprocket member and is adapted to move with respect to said wall bracket member when said carriage member moves in an up-and-down fashion;

a motor member;

wherein said motor member is connected between said wall bracket member and said carriage member, and is adapted to move said carriage member in said up-and-down fashion and thereby said at least one rack and pinion mechanism and said at least one back scrubbing disc member;

a power source;

wherein said power source is connected to said wall bracket member and is electrically connected to said motor member; and a control member;

wherein said control member is electrically connected to said motor member and controls the speed and direction of rotation of said motor member and thereby the motion of each of said at least one back scrubbing disc member.

2. The shower scrubbing device of claim 1, wherein said carriage member includes at least one elongated track member that a respective said at least one sprocket member follows along when said carriage member moves with respect to said wall bracket member.

3. The shower scrubbing device of claim 2, wherein said at least one elongated track member of said carriage member is formed having an oval shape.

4. The shower scrubbing device of claim 2, wherein each said at least one elongated track member of said carriage member is formed having a length of eighteen inches.

5. The shower scrubbing device of claim 2, wherein each said at least one sprocket member travels in said up-and-down fashion along each said at least one elongated track member in a cyclical pattern.

6. The shower scrubbing device of claim 1, wherein there are three back scrubbing disc members attached to respective three sprocket members, which are attached to respective three rack and pinion mechanisms.

7. The shower scrubbing device of claim 6, wherein said carriage member includes three elongated track members that respective said three sprocket members follow along when said carriage member moves with respect to said wall bracket member.

8. The shower scrubbing device of claim 1, further comprising a cleaning cover removably attached to each said at least one back scrubbing disc member.

9. The shower scrubbing device of claim 8, wherein each said cleaning cover includes a material thereon chosen from a group of materials consisting of cotton, nylon, sponge, rubber, metal, and plastic.

10. The shower scrubbing device of claim 1, further comprising a cover member adapted to releasably connect with said wall bracket member and encompass and cover said carriage member, said at least one rack and pinion mechanism, said at least one sprocket member, said motor member, and said power source therein.

11. The shower scrubbing device of claim 10, wherein said cover member includes a gasket member attached thereto and adapted to be located between said cover member and said wall bracket member and prevent moisture from passing into said shower scrubbing device when in use.

12. The shower scrubbing device of claim 1, wherein said wall bracket member is removably attachable to said shower wall via at least one suction cup member connected to a backside thereof.

13. The shower scrubbing device of claim 1, wherein each said at least one back scrubbing disc is formed having a diameter of seven inches.

14. The shower scrubbing device of claim 1, wherein said wall bracket member further includes a storage tray connected thereto.

15. The shower scrubbing device of claim 1, wherein said wall bracket member further includes a plurality of utility hooks connected thereto.

16. The shower scrubbing device of claim 1, wherein said power source is formed a battery member.

17. The shower scrubbing device of claim 1, wherein said control member is electrically connected to said motor member via an elongated electric cable member; and wherein said control member includes at least one control button thereon to control said motor member; and wherein said control member further includes at least one light emitting diode member thereon adapted to indicate the status of power to said motor member.

18. The shower scrubbing device of claim 1, wherein said wall bracket member is formed of two bracket members adjustably attached to one another to thereby allow said wall bracket member to be adjustable in height after it has been attached to said shower wall.

19. The shower scrubbing device of claim 18, wherein said two bracket members are adjustably attached to one via at least one spring member and at least one releasable attachment member.

20. The shower scrubbing device of claim 19, wherein said at least one releasable attachment member includes a spring biased pin member.

* * * * *